US010617238B1

(12) United States Patent
Hammond

(10) Patent No.: US 10,617,238 B1
(45) Date of Patent: Apr. 14, 2020

(54) FRAME REINFORCEMENT HANGER APPARATUS

(71) Applicant: E. Marie Hammond, Glendale, AZ (US)

(72) Inventor: E. Marie Hammond, Glendale, AZ (US)

( * ) Notice: Subject to any disclaimer, the term of this patent is extended or adjusted under 35 U.S.C. 154(b) by 0 days.

(21) Appl. No.: 16/660,871

(22) Filed: Oct. 23, 2019

(51) Int. Cl.
*A47G 1/20* (2006.01)
*A47G 1/06* (2006.01)
*A47G 1/16* (2006.01)

(52) U.S. Cl.
CPC ..... *A47G 1/0644* (2013.01); *A47G 1/162* (2013.01)

(58) Field of Classification Search
CPC . A47G 1/21; A47G 1/215; A47G 1/24; A47G 1/16; A47G 1/166; A47G 1/1666; A47G 1/1686; A47G 1/02
See application file for complete search history.

(56) References Cited

U.S. PATENT DOCUMENTS 351,673 A 10/1886 Vosburgh
994,511 A * 6/1911 Gross
2,209,972 A * 8/1940 Horwitt ..... A47G 1/0644 40/739
2,661,560 A * 12/1953 Malby ..... A47G 1/0644 40/790
2,854,774 A * 10/1958 Horwitt ..... A47G 1/08 40/739
2,939,661 A 6/1960 Waller
3,009,275 A * 11/1961 Rosenberg ..... A47G 1/0644 40/741
3,256,630 A * 6/1966 Spector ..... A47G 1/0644 40/790
D266,223 S 9/1982 Swartz
4,676,686 A 6/1987 Eisenloffel
5,100,094 A 3/1992 Handwerger
5,819,458 A 10/1998 Hadden
5,947,438 A 9/1999 Lemire
6,898,886 B1 5/2005 Montecalvo
D746,124 S * 12/2015 Toye ..... D8/349
2016/0249751 A1* 9/2016 Popkin ..... A47G 1/1666 248/475.1

* cited by examiner

*Primary Examiner* — Cassandra Davis

(57) ABSTRACT

A frame reinforcement hanger apparatus for reinforcing and hanging picture frames includes a set of three brackets each comprising a bracket back side, a perpendicular extension, and a lip. The bracket back side has a pair of string apertures extending therethrough. The perpendicular extension is coupled to the bracket back side. The lip extends perpendicularly from the extension. The set of three brackets is configured to slidingly secure a frame left side, a frame right side, and a frame bottom side of a picture frame. A pair of washers each has a washer aperture. A string is coupled through the pair of string apertures of each bracket and the washer aperture of a central washer of the pair of washers and is tied to a top washer of the pair of washers. The top washer is configured to be engaged with a frame hook or a nail.

6 Claims, 4 Drawing Sheets

FRAME REINFORCEMENT HANGER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to picture frame hardware and more particularly pertains to a new picture frame hardware for reinforcing and hanging picture frames.

(2) Description of Related Art Including Information Disclosed Under 37 CFR 1.97 and 1.98

The prior art relates to picture frame hardware.

BRIEF SUMMARY OF THE INVENTION

An embodiment of the disclosure meets the needs presented above by generally comprising a set of three brackets each comprising a bracket back side, a perpendicular extension, and a lip. The bracket back side has a pair of string apertures extending therethrough. The perpendicular extension is coupled to the bracket back side. The lip extends perpendicularly from the extension. The set of three brackets is configured to slidingly secure a frame left side, a frame right side, and a frame bottom side of a picture frame. A pair of washers each has a washer aperture. A string is coupled through the pair of string apertures of each bracket and the washer aperture of a central washer of the pair of washers and is tied to a top washer of the pair of washers. The top washer is configured to be engaged with a frame hook or a nail.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
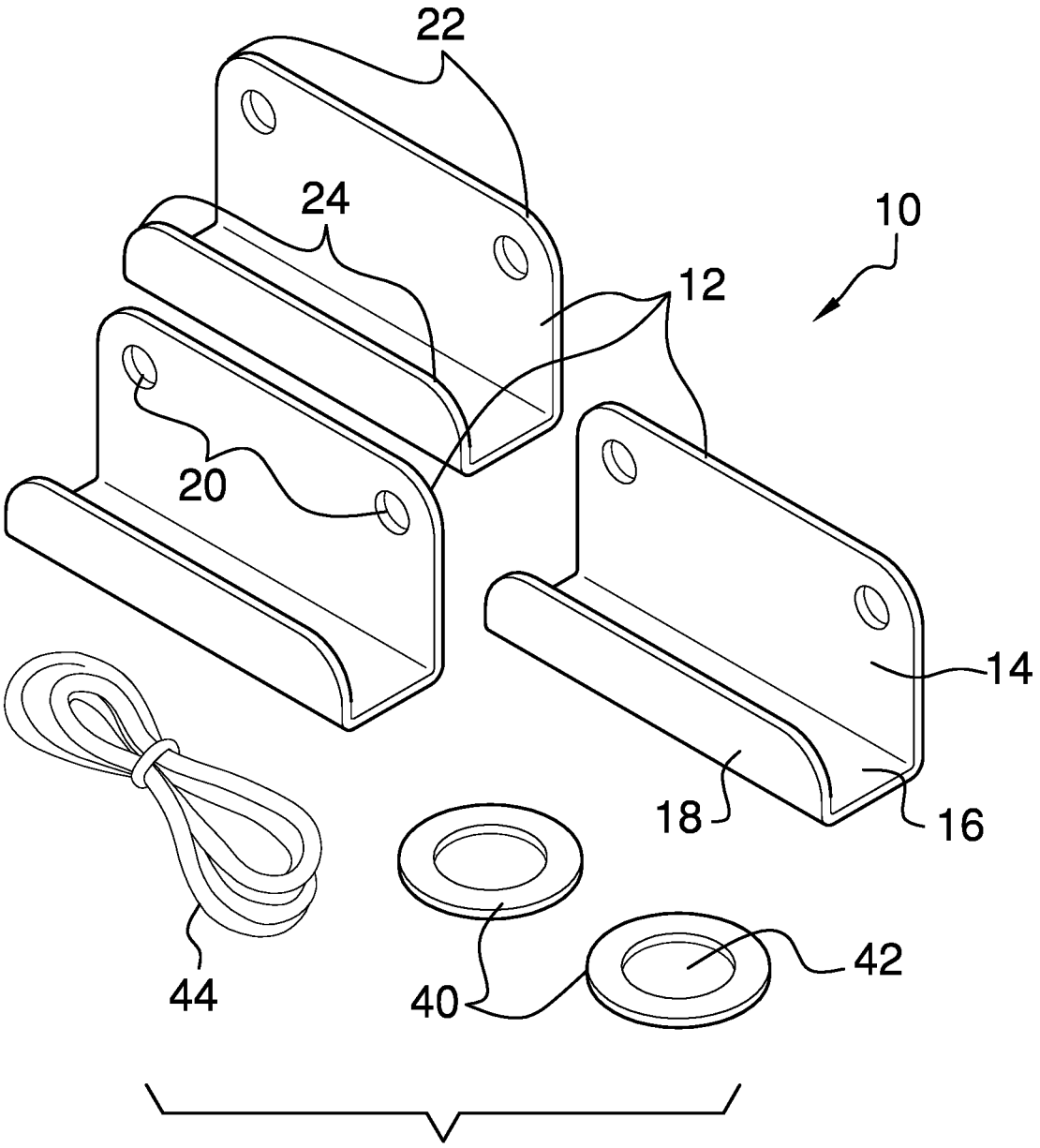
FIG. 1 is an isometric view of a frame reinforcement hanger apparatus according to an embodiment of the disclosure.
Figure 2:
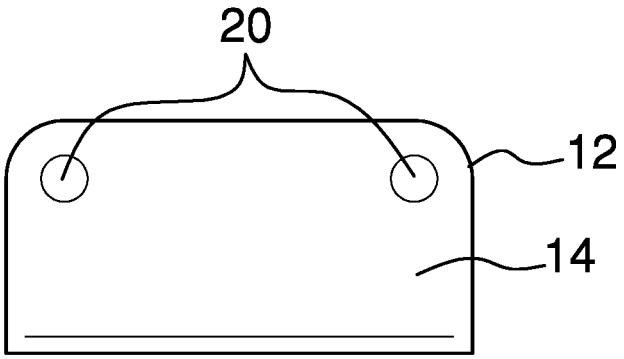
FIG. 2 is a rear elevation view of an embodiment of the disclosure.
Figure 3:
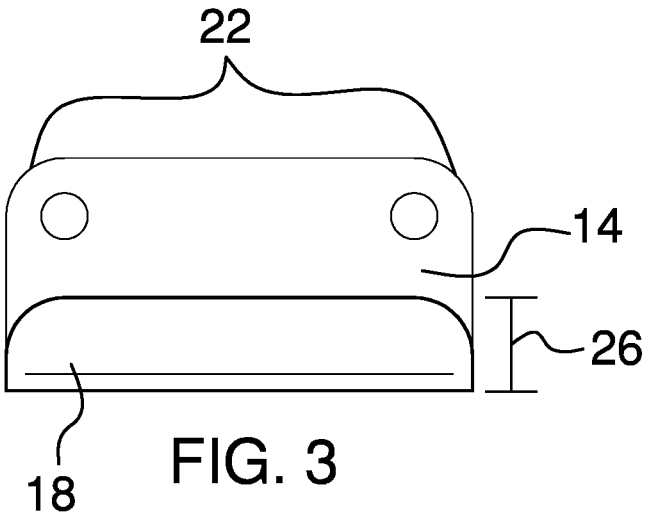
FIG. 3 is a front elevation view of an embodiment of the disclosure.
Figure 4:
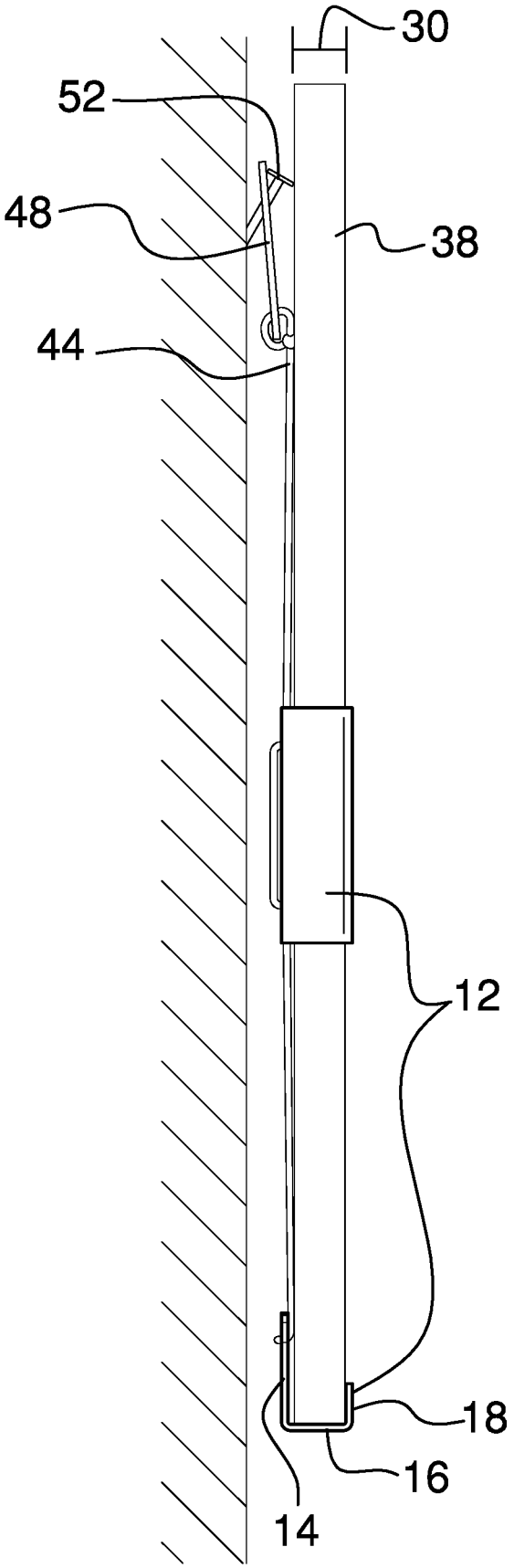
FIG. 4 is an in-use side elevation view of an embodiment of the disclosure.

With reference now to the drawings, and in particular to FIGS. 1 through 5 thereof, a new picture frame hardware embodying the principles and concepts of an embodiment of the disclosure and generally designated by the reference numeral 10 will be described.

As best illustrated in FIGS. 1 through 5, the frame reinforcement hanger apparatus 10 generally comprises a set of three brackets 12 each comprising a bracket back side 14, a perpendicular extension 16, and a lip 18 coupled to the extension 16. The bracket back side 14 has a pair of string apertures 20 extending therethrough. The bracket back side 14 may have a pair of rounded back upper corners 22. The perpendicular extension 16 is coupled to the bracket back side 14. The lip 18 extends perpendicularly from the extension 16 the lip may have a pair of rounded lip upper corners 24 to prevent snagging. A lip height 26 of the lip may be less than half of a back height 28 of the bracket back side. The lip height 26 is configured to be less than a frame thickness 30 of each of a frame left side 32, a frame right side 34, and a frame bottom side 36 of a picture frame 38. The set of three brackets 12 is configured to slidingly secure the frame left side 32, the frame right side 34, and the frame bottom side 36 of the picture frame.

A pair of washers 40 each has a washer aperture 42. A string 44 is coupled through the pair of string apertures 20 of each bracket and the washer aperture 42 of a central washer 46 of the pair of washers and tied to a top washer 48 of the pair of washers. The string 44 is a non-stretch material. The top washer 48 is configured to be engaged with a frame hook or a nail 52.

Figure 5:
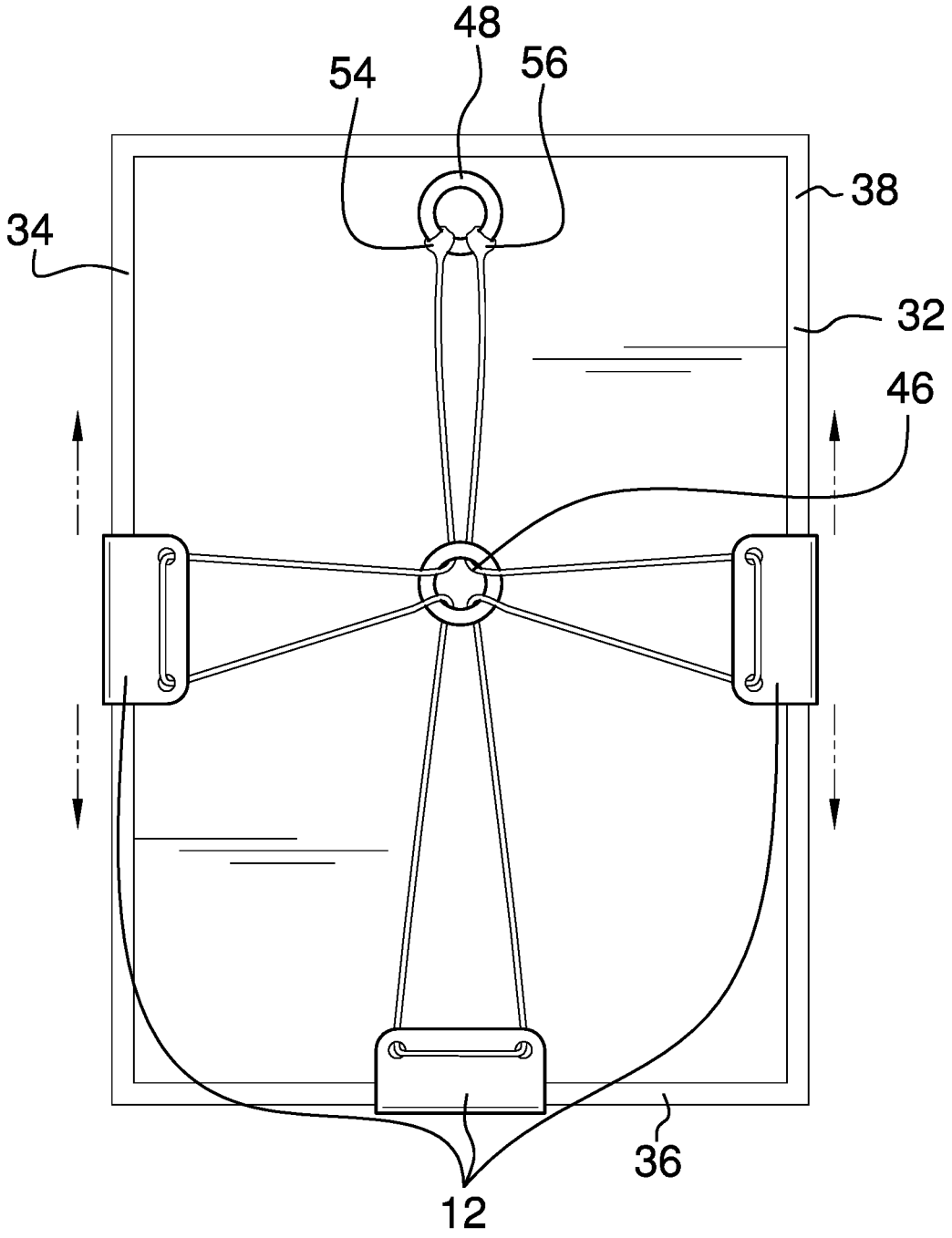
FIG. 5 is an in-use rear elevation view of an embodiment of the disclosure.

In use, a first end 54 of the string is coupled to the top washer 48 and the string 44 is passed through the washer aperture 42 of the central washer 46 and the string apertures 20 of each bracket as depicted in FIG. 5. The brackets 12 may be positioned as required on the frame left side 32 and the frame right side 34 to balance to the picture frame 38. Once set, a second end 56 of the string is tied off onto the top washer 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A frame reinforcement hanger apparatus comprising:

a set of three brackets, each bracket comprising:

a bracket back side, the bracket back side having a pair of string apertures extending therethrough;

a perpendicular extension coupled to the bracket back side; and a lip coupled to the extension, the lip extending perpendicularly from the extension;

wherein the set of three brackets is configured to slidingly secure a frame left side, a frame right side, and a frame bottom side of a picture frame;

a pair of washers, each washer having a washer aperture; and a string, the string being coupled through the pair of string apertures of each bracket and the washer aperture of a central washer of the pair of washers and tied to a top washer of the pair of washers, the top washer being configured to be engaged with a frame hook or a nail.

2. The frame reinforcement hanger apparatus of claim 1 further comprising the bracket back side having a pair of rounded back upper corners and the lip having a pair of rounded lip upper corners.

3. The frame reinforcement hanger apparatus of claim 1 further comprising a lip height of the lip being less than a back height of the bracket back side.

4. The frame reinforcement hanger apparatus of claim 1 further comprising a lip height of the lip being less than half of a back height of the bracket back side.

5. The frame reinforcement hanger apparatus of claim 1 further comprising a lip height of the lip being configured to be less than a frame thickness of each of the frame left side, the frame right side, and the frame bottom side.

6. A frame reinforcement hanger apparatus comprising:

a set of three brackets, each bracket comprising:

a bracket back side, the bracket back side having a pair of string apertures extending therethrough, the bracket back side having a pair of rounded back upper corners;

a perpendicular extension coupled to the bracket back side; and a lip coupled to the extension, the lip extending perpendicularly from the extension, the lip having a pair of rounded lip upper corners, a lip height of the lip being less than half of a back height of the bracket back side, the lip height being configured to be less than a frame thickness of each of a frame left side, a frame right side, and a frame bottom side of a picture frame;

wherein the set of three brackets is configured to slidingly secure the frame left side, the frame right side, and the frame bottom side of the picture frame;

a pair of washers, each washer having a washer aperture; and a string, the string being coupled through the pair of string apertures of each bracket and the washer aperture of a central washer of the pair of washers and tied to a top washer of the pair of washers, the top washer being configured to be engaged with a frame hook or a nail.

* * * * *